US007257480B2

(12) United States Patent
Kassner

(10) Patent No.: US 7,257,480 B2
(45) Date of Patent: Aug. 14, 2007

(54) METHOD FOR STARTING AN INTERNAL COMBUSTION ENGINE

(75) Inventor: Uwe Kassner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/250,112

(22) Filed: Oct. 12, 2005

(65) Prior Publication Data

US 2006/0142927 A1 Jun. 29, 2006

(30) Foreign Application Priority Data

Oct. 12, 2004 (DE) ..... 10 2004 049 578

(51) Int. Cl.
*F02D 45/00* (2006.01)
*F02N 17/00* (2006.01)
*F02N 17/08* (2006.01)

(52) U.S. Cl. ..... 701/112

(58) Field of Classification Search ..... None
See application file for complete search history.

(56) References Cited

U.S. PATENT DOCUMENTS 6,907,342 B1 * 6/2005 Matsuoka ..... 701/113

FOREIGN PATENT DOCUMENTS

DE 19900641 1/2000
DE 10020165 10/2001

* cited by examiner

*Primary Examiner*—Tony M. Argenbright
*Assistant Examiner*—Arnold Castro
(74) *Attorney, Agent, or Firm*—Kenyon & Kenyon LLP

(57) ABSTRACT

In a method for starting an internal combustion engine having a sensor disk which is coupled to a crankshaft of the engine, the sensor disk having a marking via an alternating arrangement of teeth and tooth spaces, and a first sensor and a second sensor each capable of generating an electric signal which may assume at least two signal levels, being associated with the sensor disk, one of the signal levels being associated with a tooth and the other signal level with a tooth space, a rising or falling signal edge of the one signal and the signal level of the other signal being used for determining the direction of rotation and increment of the angle of rotation of the crankshaft, the starting characteristics are improved in that the absolute crankshaft angle position is saved in a non-volatile memory when the engine is shut off.

5 Claims, 2 Drawing Sheets

METHOD FOR STARTING AN INTERNAL COMBUSTION ENGINE

FIELD OF THE INVENTION

The present invention relates to a method for starting an internal combustion engine having a sensor disk which is coupled to a crankshaft of the engine, the sensor disk having a marking via an alternating arrangement of teeth and tooth spaces, and a first sensor and a second sensor, each capable of generating an electric signal which may assume at least two signal levels, being associated with the sensor disk, one of the signal levels being associated with a tooth and the second signal level being associated with a tooth space, and a rising or falling signal edge of the first signal and the signal level of the second signal being used for determining the direction of rotation and increment of the rotational angle of the crankshaft, as well as to a control unit for carrying out the method.

BACKGROUND INFORMATION

Determining the crankshaft position is one of the main functions of electronic engine control. The injection of fuel, opening and closing of the inlet and outlet valves and, in the case of spark-ignition engines, the ignition for each cylinder are controlled as a function of the crankshaft angle in such a way that the individual working cycles are optimized.

Present approaches use incremental sensors on the crankshaft and/or the camshaft. Sensor disks having increment markings which, in conjunction with the signals, allow the engine position to be determined are widely used. German Patent Application No. DE 10020165 describes a method for detecting the rotational speed of an internal combustion engine, in which a sensor wheel is mounted on a rotating component. The sensor wheel includes a plurality of teeth which are scanned by the speed sensors assigned to the periphery of the sensor wheel.

One criterion for optimum engine start in automobiles is a start time which is as short as possible. It is achieved, among other things, by rapidly identifying the first suitable cylinder for fuel injection and ignition. Present engine controls need a certain rotational angle of the crankshaft for correct injection and ignition. This is due to the incremental sensors used, which are mounted on the crankshaft and the camshaft. Sensor disks having increment markings which, in conjunction with the signals, allow the engine position to be determined are widely used.

German Patent Application No. DE 19900641 describes a device and a method for detecting the rotational angle of the camshaft of a multicylinder internal combustion engine. To determine the camshaft angle, a permanent magnet and, next to it, a magnetic field-sensitive measuring recorder whose signal provides a control unit with a constant, high-resolution angle signal, are mounted on the camshaft. The advantage of the absolute angle sensor is the possibility of determining the crankshaft angle immediately after the control unit and the measuring recorder are turned on.

The disadvantages of the absolute angle sensors known from the related art include higher costs compared to the sensors for the increment system. Certain space requirements are often unable to be met due to the additional permanent magnet and measuring recorder, and additional signal processing must be implemented in the controller.

An object of the present invention is to achieve improved starting characteristics of an internal combustion engine having incremental sensors.

SUMMARY OF THE INVENTION

The above-mentioned disadvantages of the related art are eliminated by a method for starting an internal combustion engine having a sensor disk which is coupled to a crankshaft of the engine, the sensor disk having a marking via an alternating arrangement of teeth and tooth spaces, and a first sensor and a second sensor, capable of generating an electric signal which may assume at least two signal levels, being associated with the sensor disk, one of the signal levels being associated with a tooth and the second signal level being associated with a tooth space, and a rising or falling signal edge of one signal and the signal level being used for determining the direction of rotation and increment of the rotational angle of the crankshaft, and the absolute crankshaft angle position is saved in a non-volatile memory when the engine is shut off. Tooth and tooth space are also understood here as the alternating arrangement of markings, for example, of magnetic or optical markings.

The method according to the present invention may be used in particular in motor vehicles in which crankshaft rotation in the shutoff phase may be reliably avoided. These may be vehicles in which there is no rigid wheel to crankshaft coupling, or wheel rotation and thus crankshaft rotation are preventable in the shutoff phase via a system component. Examples of the first variant are vehicles having multistep automatic transmissions, in which a hydrodynamic converter is situated between the engine and the wheel. Other examples include automated manual transmissions in which the corresponding controller interrupts the linkage between wheel and crankshaft in the shutoff phase.

Examples of the second type are vehicles having automatic, e.g., electrical, parking brakes in which an actuator adequately brakes the wheels and prevents the vehicle from rolling, or in an automated manual transmission in which the transmission is blocked as such and the linkage between the clutch and the crankshaft is interrupted by decoupling via an electronically controlled actuator until the engine is restarted.

If the engine shutoff position is reliably determined in vehicles of this type, optimum engine start may take place immediately. An incremental sensor mounted on the crankshaft, which does not only deliver tooth pulses but also information about the direction of rotation, is then sufficient. The sensor wheel is scanned in a phase-shifted manner, and direction information is thus obtained. Scanning may be performed by spatially separate sensors or by sensor elements combined into one sensor. A suitable logic, implemented typically as a software counter, performs algebraic addition of these angle increments according to the direction of rotation. Each tooth edge may then be analyzed, approaches taking into account only one edge direction also being conceivable. The base value for the addition is determined by detecting the tooth space in the sensor wheel.

In a refinement of the method according to the present invention, when the engine is started, the instantaneous crankshaft angle position is read from the non-volatile memory and transmitted to the engine controller as the initial value. The engine shutoff position in the form of the crankshaft angle is saved in a non-volatile memory, for example, in the engine control unit. This value is then used to determine the first cylinder suitable for injection and ignition immediately when the engine controller is switched on. In vehicles of the second above-mentioned type, the validity of the crankshaft angle is additionally checked by querying parking brake information at the time of the engine start. This information contains data for error-free locking of the parking brake during the entire shutoff phase. This monitoring usually takes place in the self-diagnosis of the automatic parking brake. It is furthermore advantageous if the engine controller does not enable the parking brake until the engine start is completed, since rotation of the crankshaft over a wheel movement may be reliably ruled out in this case.

If the signal level of one of the sensors changes, the signal level of the other sensor is preferably determined and the direction of rotation of the crankshaft is read from a lookup table to determine the engine shutoff position. Furthermore, in the event of a signal level change of one of the sensors, a counter for the crankshaft angle is preferably incremented or decremented as a function of the direction of rotation.

In a refinement of the method according to the present invention, the parking lock status in the control unit is transmitted to the engine control unit when the engine is started, and the value saved in the non-volatile memory is accepted as the instantaneous crankshaft angle position if the parking lock has been activated since the shutoff of the engine. The parking lock may be a mechanical lock, for example, or decoupling by an actuator of an automated manual transmission, coupling of both transmission shafts in the case of a double clutch transmission, uncoupling in the case of a manual transmission, or the parking position of an automatic transmission or the like. "Activated" is understood here as setting the parking lock, for example, via a parking position of a selector lever or the like. In these cases, it is ensured that displacement of the vehicle (e.g., due to contact with other vehicles during their parking operations, due to loading or unloading of the vehicle, stopping on a slope, or the like) is not transmitted to the crankshaft via the transmission and clutch, or the torque converter. The controller which monitors the parking lock verifies whether the parking lock has been activated between shutoff and restart of the engine. If this is the case, this information is exchanged via a data link between this control unit and the engine control unit. If the parking lock has been activated for a long time, the saved value is accepted as the valid instantaneous crankshaft angle.

The above-mentioned problem is also solved by a control unit for an internal combustion engine having a sensor disk which is coupled to a crankshaft, the sensor disk having a marking via an alternating arrangement of teeth and tooth spaces, two sensors associated with the sensor disk generating an electric signal which may assume at least two signal levels, one of the signal levels being associated with a tooth and the second signal level being associated with a tooth space, a rising or falling signal edge of the first signal and the signal level of the second signal being analyzed for determining the direction of rotation and increment of the rotational angle of the crankshaft, and the control unit including a non-volatile memory for saving the crankshaft angle position of the crankshaft when the engine is shut off.

DETAILED DESCRIPTION

Figure 1:
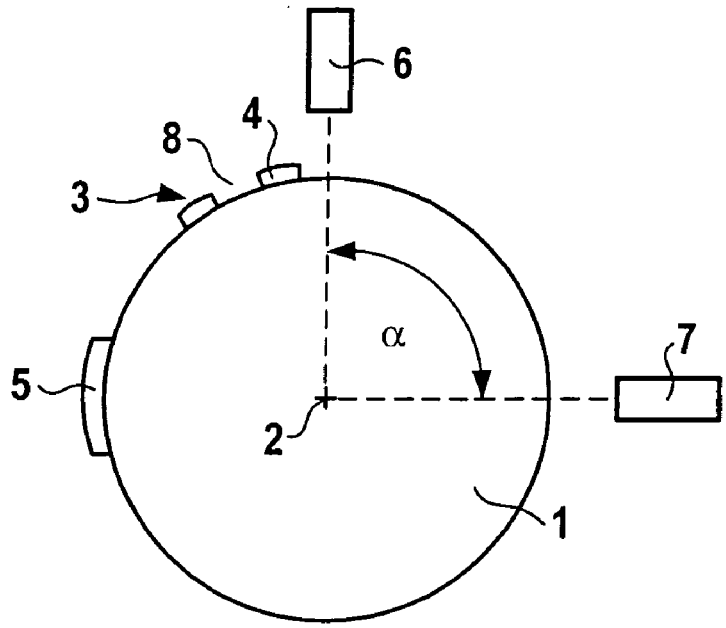
FIG. 1 shows a schematic drawing of the sensor disk and sensors.

FIG. 1 shows a schematic drawing of a sensor disk 1, which is situated directly on a crankshaft or camshaft, for example, or is indirectly connected to the camshaft with the aid of transmission elements for rotation. Sensor disk 1 rotates about an axis 2. Markings 3 are situated on the outer periphery of sensor disk 1. The markings include, for example, teeth 4, which are situated equidistant over the outer periphery of sensor disk 1. Tooth spaces 8 are situated between teeth 4. An additional marking 5, for example, as shown here in the form of a tooth 4 having double the width or in the form of a larger tooth space between two teeth 4 or the like marks an established zero position of the crankshaft. Each tooth extends over an angle of 3°; each tooth space extends over an angle of 3°. Therefore, tooth 4 and the adjacent tooth space 8 extend over an angle of 6°.

A first sensor 6 and a second sensor 7 are situated on sensor disk 1. Sensors 6, 7 are distributed in the different angle ranges over sensor disk 1. For example, the sensors may be situated at an angle $\alpha$ of 87° from one another as shown in FIG. 1; however, any other angle is also conceivable. One preferred embodiment is the integration of at least two Hall elements at a distance of a few millimeters as sensors 6, 7 on an integrated circuit, angle $\alpha$ therefore assuming small values.

When the crankshaft and thus sensor disk 1 rotate, teeth 4 and marking 5 pass by sensors 6, 7, triggering, for example, an electric signal in sensors 6, 7. Sensors 6, 7 may be inductive or capacitive sensors. Alternatively, sensors 6, 7 may also be optical sensors, for example, being able to measure the optical changes caused in them by teeth 4 or marking 5.

Figure 2:
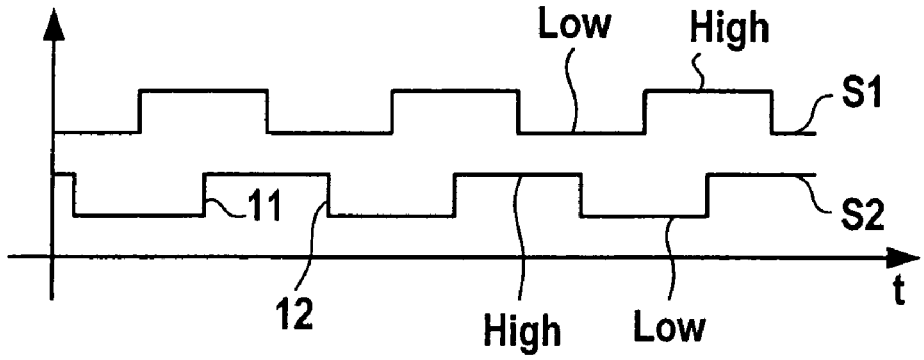
FIG. 2 shows a first example of the sensor signal curve.

FIG. 2 shows the signal curve of sensors 6, 7 over time t. The alternating passage of teeth 4 and tooth spaces 8 generates a square signal both in signal curve S1 of first sensor 6 and in signal curve S2 of second sensor 7. Both signals assume the values "high" or "low." The transition from low to high is identified as rising edge 11; the transition from high to low is identified as falling edge 12.

The schematic drawing using symmetrical spacing of the sensor disk in FIG. 2 shows which planks are evaluated. Tables 1 and 2 show their assignment for determining the direction of rotation.

Rising edge 11 is identified in the following tables 1 and 2 as "L->H". Falling edge 12 is identified as "H->L." DR denotes the direction of rotation of the crankshaft, ->denoting counterclockwise rotation, and <-denoting clockwise rotation.

TABLE 1

| S1 | S2 | DR |
|---|---|---|
| H->L | L | -> |
| L->H | H | -> |
| H | H->L | -> |
| L | L->H | -> |

TABLE 2

| S1 | S2 | DR |
|---|---|---|
| H->L | H | <- |
| L->H | L | <- |
| L | H->L | <- |
| H | L->H | <- |

During the rising or falling edge of signal S1 or S2, the direction of rotation of the crankshaft may be determined from the other signal which is then constant. For example, if the edge of signal S1 (H->L) is rising and signal S2 is on the high level, the crankshaft is rotating counterclockwise.

Figure 3:
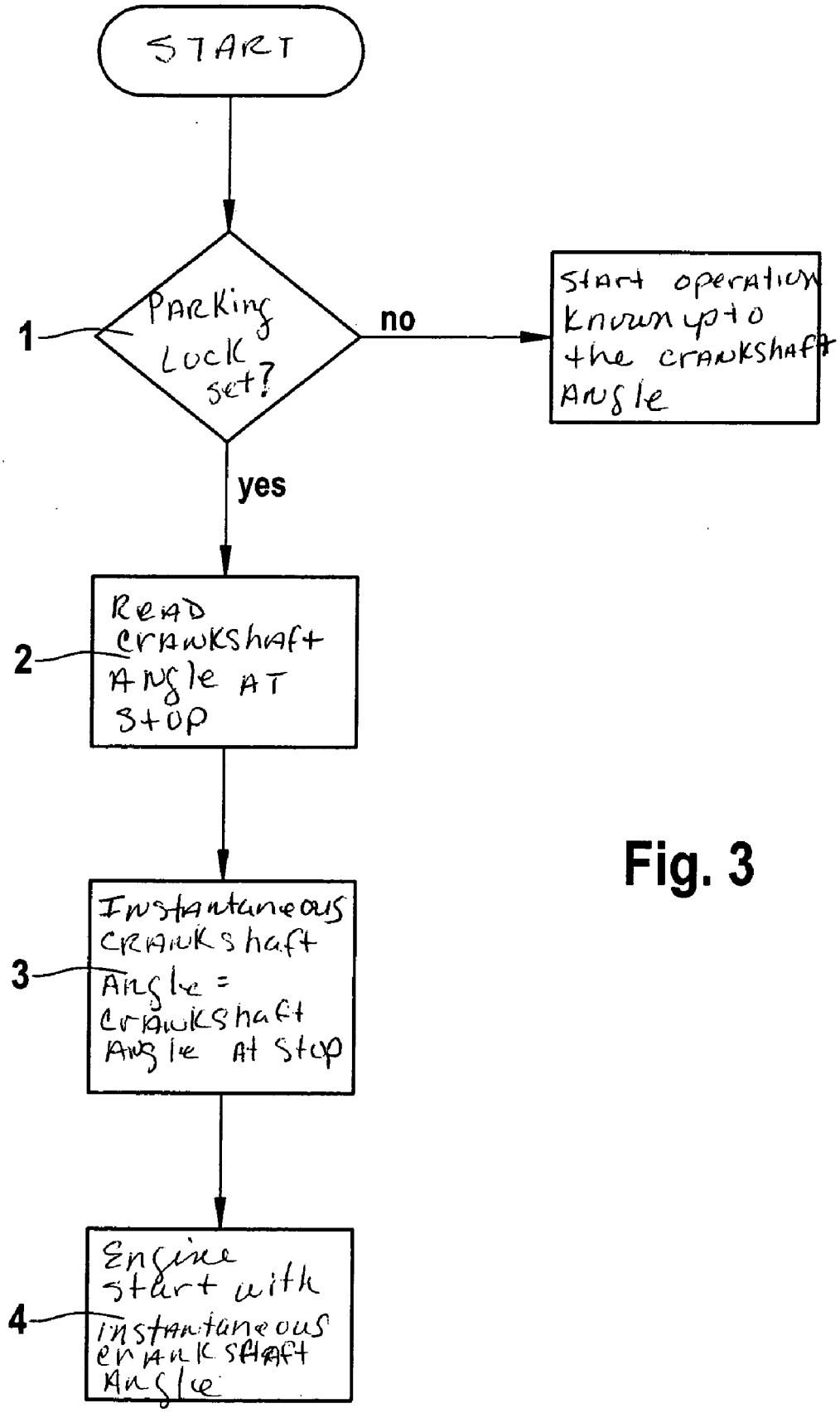
FIG. 3 shows a block diagram of the method according to the present invention.

When the engine is shut off (engine stop), the absolute crankshaft angle until full stop of the crankshaft is measured and saved in a non-volatile memory of the control unit. If the crankshaft does not continue to rotate as may occur in the case of a manual transmission with an engaged gear, the crankshaft angle measured at engine stop is still valid at the time of the following engine start. For this, the crankshaft must have definitely been uncoupled from the power train during standstill or, if this condition is not met, transmission of a wheel motion to the power train must be reliably prevented. This is ensured, for example, in the case of automatic transmissions or in the case of automated manual transmissions via a parking lock. FIG. 3 shows a block diagram of the engine start for the latter example. When starting the method, for example, by an engine start request by the driver (for example, by turning the ignition key to a start position), it is checked in a first step whether the parking lock is set. Data as to whether the parking lock was set during the entire shutoff phase may also be stored, for example, using a memory cell in a control unit. If the parking lock was turned off manually, for example, (for example, for towing in the case of a breakdown), this status is equated with a parking lock which is no longer set, because the crankshaft may have continued to rotate. If the parking lock is not set (the decision in step 1 is "no"), the engine starts with an initially unknown crankshaft angle. In this case the crankshaft position is determined in the known manner while the engine is rotated by the starter from the signals of the sensors on the crankshaft and camshaft. If the crankshaft position is unambiguously known, the control unit causes fuel to be injected into and ignited in the cylinder that follows next in time.

If the decision in step 1 is "yes," i.e., the parking lock is set or was set during the entire period between engine shutoff and engine start, the absolute crankshaft angle saved in the non-volatile memory at the time of engine shutoff is read in a step 2. This crankshaft angle is now transmitted to the control unit as the instantaneous crankshaft angle in a step 3. Startup of the engine continues (step 4) with the instantaneous crankshaft angle, i.e., injection and ignition may take place immediately in the next suitable cylinder. The start time is thus minimized.

What is claimed is:

1. A method for starting an internal combustion engine, comprising:

providing a sensor disk coupled to a crankshaft of the engine, the sensor disk having a marking via an alternating arrangement of teeth and tooth spaces;

providing a first sensor and a second sensor each capable of generating an electric signal which can assume at least two signal levels, being associated with the sensor disk, one of the signal levels being associated with a tooth and another of the signal levels with a tooth space, one of a rising and falling signal edge of the one signal and the signal level of the another signal being used for determining a direction of rotation and an increment of an angle of rotation of the crankshaft; and providing a non-volatile memory for saving an absolute crankshaft angle position when the engine is shut off;

wherein, when the engine is started, a status of a parking lock in a control unit is transmitted to an engine control unit and a value saved in the non-volatile memory is accepted as an instantaneous crankshaft angle position if the parking lock has been activated since the shutoff of the engine.

2. The method according to claim 1, wherein, when the engine is started, an instantaneous crankshaft angle position is read from the non-volatile memory and transmitted to an engine controller as an initial value.

3. The method according to claim 1, wherein, if the signal level of one of the sensors changes, the signal level of the other sensor is determined and the direction of rotation of the crankshaft is read from an assignment table.

4. The method according to claim 1, further comprising providing a counter for the crankshaft angle, and wherein, in the event of a change in the signal level of one of the sensors, the counter is one of incremented and decremented as a function of the direction of rotation.

5. A control system for an internal combustion engine comprising:

a sensor disk coupled to a crankshaft, the sensor disk having a marking via an alternating arrangement of teeth and tooth spaces;

two sensors associated with the sensor disk generating an electric signal which can assume at least two signal levels, one of the signal levels being associated with a tooth and another of the signal levels with a tooth space, and one of a rising and falling signal edge of the one signal and the signal level of the another signal being used for determining a direction of rotation and an increment of a rotation angle of the crankshaft; and a control unit including a non-volatile memory for saving a crankshaft angle position when the engine is shut off;

wherein, when the engine is started, a status of a parking lock in the control unit is transmitted to an engine control unit and a value saved in the non-volatile memory is accepted as an instantaneous crankshaft angle position if the parking lock has been activated since the shutoff of the engine.

* * * * *